US010514242B1

(12) United States Patent
Yang

(10) Patent No.: US 10,514,242 B1
(45) Date of Patent: Dec. 24, 2019

(54) METHOD AND APPARATUS FOR ELECTROCHEMICAL AMMUNITION DISPOSAL AND MATERIAL RECOVERY

(71) Applicant: The University of Massachusetts, Boston, MA (US)

(72) Inventor: Chen-Lu Yang, Westport, MA (US)

(73) Assignee: THE UNIVERSITY OF MASSACHUSETTS, Boston, MA (US)

( * ) Notice: Subject to any disclaimer, the term of this patent is extended or adjusted under 35 U.S.C. 154(b) by 249 days.

(21) Appl. No.: 15/293,717

(22) Filed: Oct. 14, 2016

Related U.S. Application Data

(60) Provisional application No. 62/241,251, filed on Oct. 14, 2015.

(51) Int. Cl.

| | |
|---|---|
| ***C25C 1/12*** | (2006.01) |
| ***C25C 1/16*** | (2006.01) |
| ***F42B 33/06*** | (2006.01) |
| ***C25C 7/00*** | (2006.01) |

(52) U.S. Cl.
CPC ..... *F42B 33/06* (2013.01); *C25C 1/12* (2013.01); *C25C 1/16* (2013.01); *C25C 7/00* (2013.01)

(58) Field of Classification Search
CPC ... F24B 33/06; C25C 1/00; C25C 1/12; C25C 1/16
See application file for complete search history.

(56) References Cited

U.S. PATENT DOCUMENTS

| | | | | |
|---|---|---|---|---|
| 1,920,820 A * | 8/1933 | Rose | C25C 1/12 | 205/496 |
| 3,054,736 A * | 9/1962 | Savage | C25C 1/12 | 204/208 |
| 3,620,953 A * | 11/1971 | Inoue | B24B 31/00 | 204/198 |
| 3,959,096 A | 5/1976 | Langer | | |
| 4,242,192 A * | 12/1980 | Dunning, Jr. | C25C 7/007 | 204/212 |
| 4,252,621 A | 2/1981 | Reinhardt et al. | | |
| 4,539,087 A | 9/1985 | Pojbics et al. | | |
| 4,678,552 A | 7/1987 | Chen | | |

(Continued)

FOREIGN PATENT DOCUMENTS

| | | | |
|---|---|---|---|
| GB | 1290672 A * | 9/1972 | C25C 1/12 |

OTHER PUBLICATIONS

Bevan, "Conventional Ammunition in Surplus, A Reference Guide", Small Arms Survey, 2008, Ch. 9, pp. 85-102.

(Continued)

*Primary Examiner* — Salil Jain
(74) *Attorney, Agent, or Firm* — Cantor Colburn LLP

(57) ABSTRACT

In a method for electrochemical ammunition disposal and material recovery, ammunition cartridges are placed in an acidic aqueous solution that is in contact with a cathode and an anode. The ammunition cartridges have a casing that includes an alloy of copper and zinc. The ammunition cartridges are agitated in the acidic aqueous solution as a voltage is applied between the anode and the cathode. The applied voltage is effective to oxidize and dissolve zinc from the copper-zinc alloy. Copper metal derived from the alloy can be recovered as a solid, and zinc ion derived from the alloy can be recovered as a solution.

20 Claims, 8 Drawing Sheets

(56) References Cited

U.S. PATENT DOCUMENTS

| | | | | |
|---|---|---|---|---|
| 4,789,444 | A | 12/1988 | Watanabe et al. | |
| 5,810,995 | A * | 9/1998 | Soilleux | A62D 3/11 204/267 |
| 6,011,193 | A * | 1/2000 | Myler | A62D 3/11 588/318 |
| 2015/0308804 | A1 * | 10/2015 | Seeman | F42B 12/74 102/430 |

OTHER PUBLICATIONS

Biddle, I., "Environmentally Responsible SAA Disposal" Journal of ERW and Mine Action, vol. 18, Issue 1, Article 7, (2015) pp. 26-28.
Georgiev, A. V., "Planning and Management of the Surplus Ammunition Disposal Process in the Bulgarian Armed Forces", Calhoun: The NPS Institutional Archive (2004) pp. 23-28 (http://hdl.handle.net/10945/9931).
Government of Germany, "OSCE Handbook of Best Practices in Conventional Ammunition, Decision No. 6/08 Handbook of Best Practices on Conventional Ammunition" , 2008, p. 159 (3 pages).

* cited by examiner

METHOD AND APPARATUS FOR ELECTROCHEMICAL AMMUNITION DISPOSAL AND MATERIAL RECOVERY

CROSS-REFERENCE TO RELATED APPLICATIONS

This application claims priority to U.S. Provisional Patent Application No. 62/241,251, filed 14 Oct. 2015, which is incorporated by reference herein in its entirety.

BACKGROUND OF THE INVENTION

The present invention relates generally to disposal of ammunition, and specifically to a method and apparatus for electrochemical ammunition disposal and material recovery.

Armed forces, police organizations, and other armed entities world-wide possess large quantities of surplus and obsolete ammunition. Existing ammunition disposal processes have serious disadvantages. For example, ocean dumping and disposal in landfills are no longer environmentally acceptable. Disassembly and pre-treatment to remove or render safe the explosive components is costly and requires extensive safety measures. The same concerns apply to destruction of ammunition by detonation methods, which further make component separation and recovery difficult. And long-term storage of surplus and obsolete ammunition is neither safe nor cost-effective.

What is needed is a method for disposing of ammunition while separating and recovering its major components.

SUMMARY

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

The present invention is directed towards electrochemical ammunition disposal and material recovery.

In an aspect, the invention features an apparatus including a container including an acidic solution, an anode hanging into the acidic solution on one side of the container and comprising an ammunition cartridge, a cathode hanging into the acidic solution on an opposite side of the container and comprising a titanium plate, and a direct current (DC) power supply to apply a 7.5 V direct current between the anode and the cathode.

In another aspect, the invention features a method including hanging an ammunition cartridge into one side of a container of acidic solution, hanging a titanium plate into an opposite side of the container of acidic solution, linking a direct current (DC) power supply to the ammunition cartridge and the titanium plate, and applying a 7.5 V direct current between the ammunition cartridge and the titanium plate producing a current of 3 amps is over the ammunition cartridge and the titanium plate through the acidic solution.

In another aspect, the invention features a method for electrochemical ammunition disposal and material recovery, the method comprising: placing a plurality of ammunition cartridges in an acidic aqueous solution that is in contact with a cathode and an anode; wherein at least a portion of the ammunition cartridges comprise a casing comprising an alloy comprising copper and zinc; agitating the plurality of cartridges within the acidic aqueous solution; applying a voltage between the anode and the cathode, the voltage being effective to oxidize and dissolve zinc from the alloy comprising copper and zinc; and recovering alloy-derived metallic copper as a solid, and alloy-derived zinc ion as a solution.

In another aspect, the invention features an apparatus for electrochemical ammunition disposal and material recovery, the apparatus comprising: a solution-permeable container comprising a solution-permeable outer layer of electrically insulating material substantially surrounding other components of the container and defining a volume, an anode comprising lead and disposed on an inner surface of the outer layer or within the volume defined by the outer layer, and a cathode comprising copper, disposed within the volume defined by the outer layer, and physically separated from the anode; an acid bath adapted for least partially immersing the solution-permeable container in an acidic aqueous solution; an agitator for agitating the solution-permeable container in the acid bath; and a power supply for applying a voltage between the anode and the cathode.

Embodiments of the invention may have one or more of the following advantages.

Existing technologies are all based on thermal destruction of cartridges. The present invention is based on applying electric current to promote the dissolution of ammunition shells in order to release energetic materials and separate the other metals for further recovery.

The present invention minimizes or avoids shortcomings of existing technologies, such as, for example, safety issues, air and soil pollutions, transportation, and capital cost.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

The invention will be more fully understood by reference to the detailed description, in conjunction with the figures.

DETAILED DESCRIPTION

Figure 1:
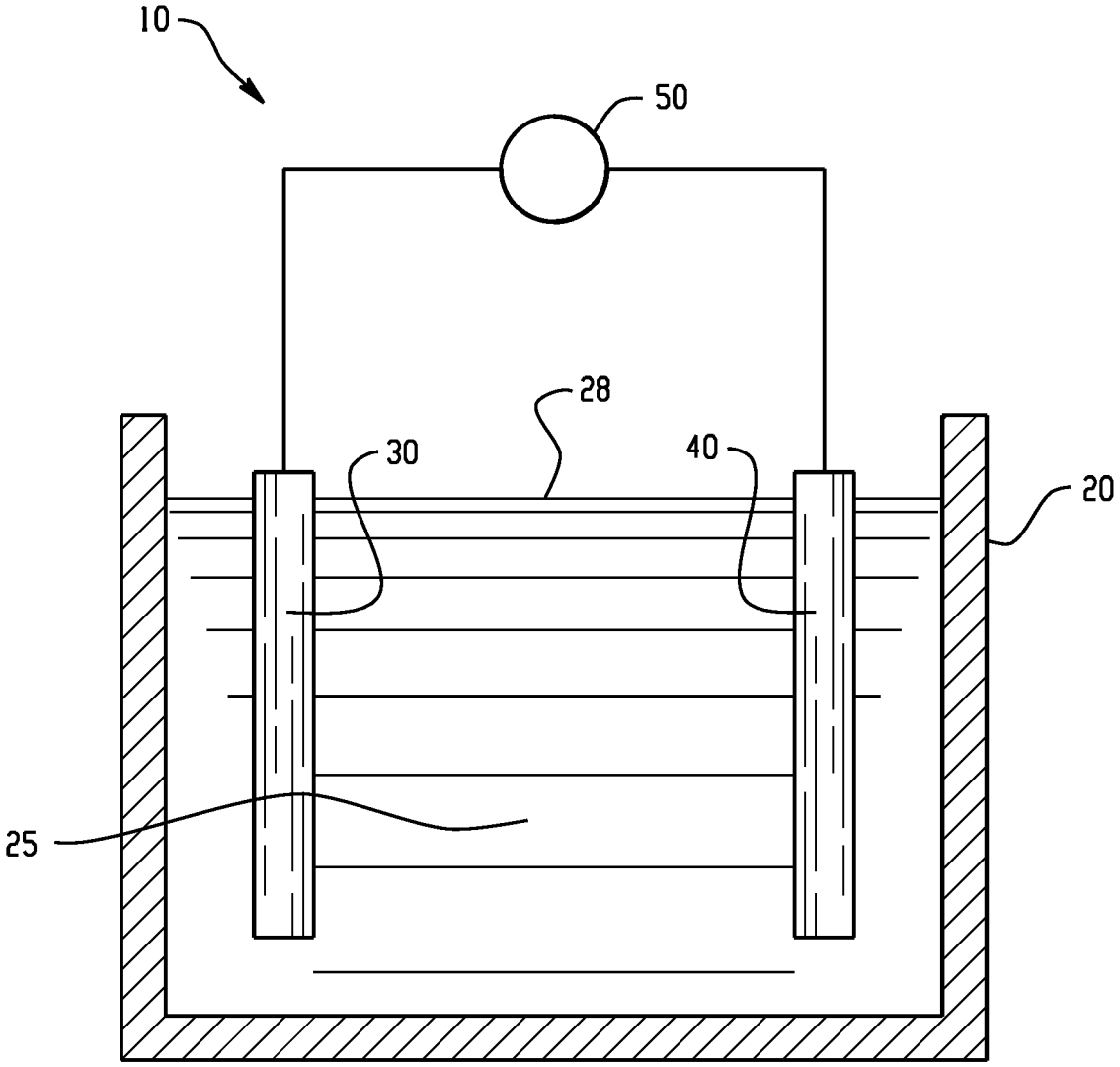
FIG. 1 is a schematic illustration of an exemplary electrochemical ammunition disposal and material recovery apparatus in accordance with one embodiment of the invention.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

In the description below, the term "or" is intended to mean an inclusive "or" rather than an exclusive "or." That is, unless specified otherwise, or clear from context, "X employs A or B" is intended to mean any of the natural inclusive permutations. That is, if X employs A, X employs B, or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form.

Some embodiments may be described using the expression "one embodiment" or "an embodiment" along with their derivatives. These terms mean that a particular feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. These terms are not necessarily intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other.

The present invention is a technique to separate the major components in ammunition cartridges for further materials recovery. Due to the simplicity of the operation of the present invention, air and soil pollution are minimized.

The present invention is useful for disposal of small arms ammunition with brass cartridges, although it may be adapted to other types of ammunition.

In general, a cartridge (also called a round or a shell) is a type of ammunition packaging a bullet or shot, a propellant substance, and a primer within a metallic, paper, or plastic case that is precisely made to fit within the firing chamber of a firearm. The primer is a small charge of an impact-sensitive or electric-sensitive chemical mixture that can be located at the center of the case head, inside a rim, or in a projection such as in a pinfire or teat-fire cartridge. Military and commercial producers continue to pursue the goal of caseless ammunition. Some artillery ammunition uses the same cartridge concept as found in small arms. In other cases, the artillery shell is separate from the propellant charge.

Components of ammunition intended for machine guns, rifles and pistols may be divided into explosive materials (gunpowder), projectiles (lead bullet heads) and cartridge cases (brass shells). Brass is an alloy of copper and zinc. The present invention enables separation of the four components of lead, gunpowder, copper and zinc for further recovery.

Water corrodes brass shells over a long period of time. Acids and caustics promote the corrosion process. Electric current enhances the metal dissolution process tremendously. The present invention uses electric current to enhance the dissolution of a shell in a diluted acid solution, thus releasing energetic material and separating the other three metals.

As shown in FIG. 1, an exemplary electrochemical ammunition disposal and material recovery apparatus 10 includes a container 20. The container 20 includes an acidic solution 25, which fills the container 20 to level 28. In a preferred embodiment, the solution is 100 mL 0.5 M (~5% w/w) sulfuric acid. An ammunition cartridge 30 hangs on one side of the container 20, acting as an anode in the acidic solution 25. A titanium plate 40 hangs on the other side of the container 20 as the receiving electrode (i.e., cathode). A direct current (DC) power supply 50 is connected to each of the ammunition cartridge 30 and the titanium plate 40. The DC power supply 50 is used to apply a 7.5 V direct current between the two electrodes 30, 40. A current of 3 amps is carried over the two electrodes 30, 40 through the acidic solution 25. During the operation, zinc is oxidized to zinc ions and dissolved in the solution 25. Copper is oxidized to copper ions and dissolved as copper sulfate, which has a strong navy blue hue in the acidic solution 25. In approximately ten minutes, a significant portion of the ammunition cartridge 30 is dissolved in the acidic solution 25, pure copper metal is collected on the titanium cathode 40 and lead dropped to the bottom of the container 20. Due to the relatively light weight, the gunpowder floats to the surface of the acidic solution 25.

One embodiment is a method for electrochemical ammunition disposal and material recovery, the method comprising: placing a plurality of ammunition cartridges in an acidic aqueous solution that is in contact with a cathode and an anode; wherein at least a portion of the ammunition cartridges comprise a casing comprising an alloy comprising copper and zinc; agitating the plurality of cartridges within the acidic aqueous solution; applying a voltage between the anode and the cathode, the voltage being effective to oxidize and dissolve zinc from the alloy comprising copper and zinc; and recovering alloy-derived metallic copper as a solid, and alloy-derived zinc ion as a solution.

As used herein, the term "plurality" means at least three. However, the "plurality of ammunition cartridges" can correspond to an ammunition cartridge quantity on the order of kilograms or greater. There is no particular limit to the size or quantity of the ammunition cartridges, because the method and apparatus are scalable. In some embodiments, at least a portion of the ammunition cartridges have a caliber of 0.1 to 2 or greater (corresponding to a barrel diameter of 2.54 to 50.8 millimeters, or greater); or a caliber of 0.2 to 1 (corresponding to a barrel diameter of 5.08 to 25.4 millimeters), or 0.2 to 0.5 (corresponding to a barrel diameter of 5.08 to 12.7 millimeters).

It will be understood that while the method has been illustrated in the context of disposal of small arms ammunition, it is also applicable to larger scale ammunition types, and the electrochemical process parameters can be modified to recover metals other than or in addition to copper, zinc, and lead. Such other metals can include tin (e.g., as an alloy with lead), nickel (e.g., as an alloy with copper), tellurium (e.g., as an alloy with copper), iron (e.g., in a steel jacket), tungsten and depleted uranium (e.g., for armor piercing), among others. The skilled electrochemist can adjust the electrochemical conditions of the method to recover such other metals. Generally, metals in alloys behave in one of three ways under the process conditions: (1) they dissolve in the acidic aqueous solution, (2) they dissolve from the alloy and redeposit on the cathode as metal, or (3) they do not dissolve, but because other metal(s) in the alloy dissolve, they are transformed to a typically powdered form of metal, which collects at the bottom of the container holding the acidic aqueous solution. For example, tellurium will not dissolve and will collect at the bottom of the container holding the acidic aqueous solution. As another example, zinc will dissolve in the acidic aqueous solution, from which it can be recovered by adding a soluble phosphate salt to the acidic aqueous solution, which creates a zinc phosphate precipitate.

The method recites steps, but the steps are not necessarily conducted in the order in which they are recited. For example, the voltage can be applied before the cartridges are agitated, or even before the cartridges are placed in the acidic aqueous solution.

In a specific embodiment of the method, placing a plurality of ammunition cartridges in an acidic aqueous solution comprises enclosing the ammunition cartridges in a solution-permeable container comprising the anode and the cathode, and at least partially immersing the solution-permeable container in the acidic aqueous solution; wherein the solution-permeable container further comprises a solution-permeable outer layer of electrically insulating material substantially enclosing the ammunition cartridges; wherein the anode comprises lead; and wherein the cathode comprises copper. In this embodiment, the electrically insulating material can comprise a thermoplastic having a volume resistivity of at least $10^{12}$ ohm-centimeters, or at least $10^{13}$ ohm-centimeters, or $10^{12}$ to $10^{16}$ ohm-centimeters. Also in this embodiment, agitating can, optionally, be accomplished by rotating the solution-permeable container within the acidic aqueous solution. Suitable rotation rates can be, for example, 0.1 to 10 rotations per minute, or 0.5 to 5 rotations per minute.

In some embodiments, agitating the ammunition cartridges causes them to make physical contact with the anode, which can increase the electrical efficiency of the method.

The method is suitable for whole ammunition. For example, in some embodiments, at least a portion of the ammunition cartridges further comprise a bullet, a primer, and gunpowder in addition to the alloy comprising copper and zinc.

In some embodiments, the anode comprises at least 80 weight percent lead, or at least 90 weight percent lead, or at least 95 percent lead, based on the weight of the anode.

In some embodiments, the cathode comprises at least 50 weight percent copper, or at least 80 weight percent copper, or at least 90 weight percent copper, or at least 95 weight percent copper, based on the weight of the cathode. The cathode can also comprise a brass alloy comprising 50 to 80 weight percent copper and 20 to 50 weight percent zinc, based on the weight of the cathode. The brass alloy can, optionally, contain small amounts of other metals including tin, iron, lead, and aluminum.

The anode and the cathode are, of course, physically separated. An effective physical separation of the anode and the cathode will depend on the scale of the apparatus and can be determined by the skilled person. In some embodiments, physical separation of the anode and the cathode is at least 2 centimeters, or at least 5 centimeters, or at least 10 centimeters.

The method utilizes an acidic aqueous solution. The solution preferably comprises a strong acid, preferably a strong inorganic acid. Suitable acids include nitric acid, sulfuric acid, hydrochloric acid, and combinations thereof. In some embodiments, the acid comprises sulfuric acid. The concentration of acid in the acidic aqueous solution can be, for example, 2 to 30 weight percent, or 2 to 25 weight percent, or 2 to 20 weight percent, or 5 to 20 weight percent, based on the total weight of the acidic aqueous solution. In some embodiments the acidic aqueous solution comprises sulfuric acid at a concentration of 5 to 20 weight percent. In some embodiments, the acidic aqueous solution comprises sulfuric acid, wherein at least a portion of the alloy-derived metallic copper is recovered as a powdered solid, and wherein at least a portion of the alloy-derived zinc ion is recovered as a zinc sulfate solution. In some embodiments of the recovered, alloy-derived metallic copper, the powdered solid has a number average particle size of about 1 micrometer to about 2 millimeters, as determined by laser diffraction analysis.

In some embodiments, at least a portion of the ammunition cartridges further comprise a bullet comprising lead, a primer, and gunpowder; and at least a portion of bullet-derived lead, at least a portion of the primer, and at least a portion of the gunpowder are each recovered as solids.

The method includes applying a voltage between the anode and the cathode, the voltage being effective to oxidize and dissolve zinc from the alloy comprising copper and zinc. The voltage can be varied to achieve a desirable current, which in turn is proportional to the disposal rate of the ammunition. In some embodiments, the voltage between the anode and the cathode is 0.5 to 20 volts, or 1 to 10 volts, or 1 to 5 volts.

The skilled electrochemist understands that the process parameters of voltage, anode surface area, cathode surface area, and anode-cathode separation are interrelated and can be adjusted to provide a desired current.

In a very specific embodiment of the method, the ammunition cartridges each independently have a caliber of 0.1 to 2; at least a portion of the ammunition cartridges further comprise a bullet comprising lead, a primer, and gunpowder; the anode comprises at least 80 weight percent lead; the cathode comprises at least 80 weight percent copper; the acidic aqueous solution comprises sulfuric acid at a concentration of 5 to 20 weight percent; and at least a portion of bullet-derived lead, at least a portion of the primer, and at least a portion of the gunpowder are each recovered as solids.

Another embodiment is an apparatus for electrochemical ammunition disposal and material recovery, the apparatus comprising: a solution-permeable container comprising a solution-permeable outer layer of electrically insulating material substantially surrounding other components of the container and defining a volume, an anode comprising lead and disposed on an inner surface of the outer layer or within the volume defined by the outer layer, and a cathode comprising copper, disposed within the volume defined by the outer layer, and physically separated from the anode; an acid bath adapted for least partially immersing the solution-permeable container in an acidic aqueous solution; an agitator for agitating the solution-permeable container in the acid bath; and a power supply for applying a voltage between the anode and the cathode.

As described above in the context of one embodiment of the method, the electrically insulating material can comprise a thermoplastic having a volume resistivity of at least $10^{12}$ ohm-centimeters, or at least $10^{13}$ ohm-centimeters, or $10^{12}$ to $10^{16}$ ohm-centimeters.

In some embodiments, the anode comprises at least 80 weight percent lead, or at least 90 weight percent lead, or at least 95 percent lead, based on the weight of the anode.

In some embodiments, the cathode comprises at least 50 weight percent copper, or at least 80 weight percent copper, or at least 90 weight percent copper, or at least 95 weight percent copper, based on the weight of the cathode. The cathode can also comprise a brass alloy comprising 50 to 80 weight percent copper and 20 to 50 weight percent zinc, based on the weight of the cathode. The brass alloy can, optionally, contain small amounts of other metals including tin, iron, lead, and aluminum.

In a very specific embodiment of the apparatus, the electrically insulating material comprises a thermoplastic having a volume resistivity of at least $10^{12}$ ohm-centimeters; the anode comprises at least 80 weight percent lead; and the cathode comprises at least 80 weight percent copper.

The invention includes at least the following embodiments.

Embodiment 1

A method for electrochemical ammunition disposal and material recovery, the method comprising: placing a plurality of ammunition cartridges in an acidic aqueous solution that is in contact with a cathode and an anode; wherein at least a portion of the ammunition cartridges comprise a casing comprising an alloy comprising copper and zinc; agitating the plurality of cartridges within the acidic aqueous solution; applying a voltage between the anode and the cathode, the voltage being effective to oxidize and dissolve zinc from the alloy comprising copper and zinc; and recovering alloy-derived metallic copper as a solid, and alloy-derived zinc ion as a solution.

Embodiment 2

The method of embodiment 1, wherein said placing a plurality of ammunition cartridges in an acidic aqueous solution comprises enclosing the ammunition cartridges in a solution-permeable container comprising the anode and the cathode, and at least partially immersing the solution-permeable container in the acidic aqueous solution; wherein the solution-permeable container further comprises a solution-permeable outer layer of electrically insulating material substantially enclosing the ammunition cartridges; wherein the anode comprises lead; and wherein the cathode comprises copper.

Embodiment 3

The method of embodiment 2, wherein the electrically insulating material comprises a thermoplastic having a volume resistivity of at least $10^{12}$ ohm-centimeters.

Embodiment 4

The method of embodiment 2 or 3, wherein said agitating the plurality of cartridges within the acidic aqueous solution comprises rotating the solution-permeable container.

Embodiment 5

The method of any one of embodiments 1-4, wherein at least a portion of the ammunition cartridges have a caliber of 0.1 to 2.

Embodiment 6

The method of any one of embodiments 1-5, wherein at least a portion of the ammunition cartridges further comprise a bullet, a primer, and gunpowder.

Embodiment 7

The method of any one of embodiments 1-6, wherein the anode comprises at least 80 weight percent lead.

Embodiment 8

The method of any one of embodiments 1-7, wherein the cathode comprises at least 50 weight percent copper.

Embodiment 9

The method of any one of embodiments 1-8, wherein the acidic aqueous solution comprises sulfuric acid at a concentration of 5 to 20 weight percent, based on the weight of the acidic aqueous solution.

Embodiment 10

The method of any one of embodiments 1-9, wherein the voltage between the anode and the cathode is 0.5 to 20 volts.

Embodiment 11

The method of any one of embodiments 1-10, wherein the acidic aqueous solution comprises sulfuric acid, wherein at least a portion of the alloy-derived metallic copper is recovered as a powdered solid, and wherein at least a portion of the alloy-derived zinc ion is recovered as a zinc sulfate solution.

Embodiment 12

The method of any one of embodiments 1-11, wherein at least a portion of the ammunition cartridges further comprise a bullet comprising lead, a primer, and gunpowder; and wherein at least a portion of bullet-derived lead, at least a portion of the primer, and at least a portion of the gunpowder are each recovered as solids.

Embodiment 13

The method of embodiment 1, wherein the ammunition cartridges each independently have a caliber of 0.1 to 2; at least a portion of the ammunition cartridges further comprise a bullet comprising lead, a primer, and gunpowder; the anode comprises at least 80 weight percent lead; the cathode comprises at least 80 weight percent copper; the acidic aqueous solution comprises sulfuric acid at a concentration of 5 to 20 weight percent; and at least a portion of bullet-derived lead, at least a portion of the primer, and at least a portion of the gunpowder are each recovered as solids.

Embodiment 14

An apparatus for electrochemical ammunition disposal and material recovery, the apparatus comprising: a solution-permeable container comprising a solution-permeable outer layer of electrically insulating material substantially surrounding other components of the container and defining a volume, an anode comprising lead and disposed on an inner surface of the outer layer or within the volume defined by the outer layer, and a cathode comprising copper, disposed within the volume defined by the outer layer, and physically separated from the anode; an acid bath adapted for least partially immersing the solution-permeable container in an acidic aqueous solution; an agitator for agitating the solution-permeable container in the acid bath; and a power supply for applying a voltage between the anode and the cathode.

Embodiment 15

The apparatus of embodiment 14, wherein electrically insulating material comprises a thermoplastic having a volume resistivity of at least $10^{12}$ ohm-centimeters.

Embodiment 16

The apparatus of embodiment 14 or 15, wherein the anode comprises at least 80 weight percent lead.

Embodiment 17

The apparatus of any one of embodiments 14-16, wherein the cathode comprises at least 50 weight percent copper.

Embodiment 18

The apparatus of embodiment 14, wherein the electrically insulating material comprises a thermoplastic having a volume resistivity of at least $10^{12}$ ohm-centimeters; the anode comprises at least 80 weight percent lead; and the cathode comprises at least 80 weight percent copper.

The invention is further illustrated by the following non-limiting example.

Example

This example illustrates electrochemical ammunition disposal and material recovery according to an embodiment of the invention.

Figure 2:
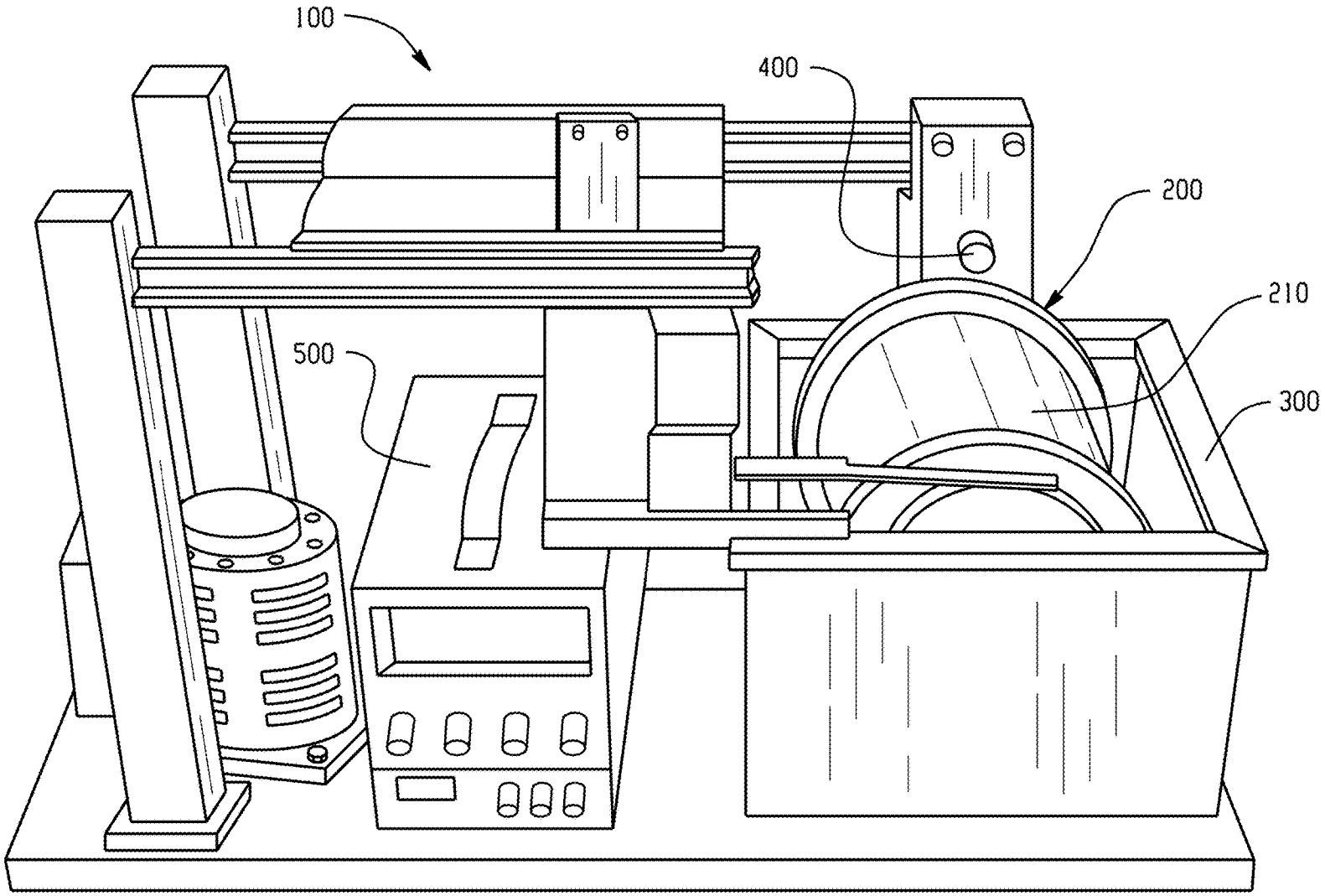
FIG. 2 is an image of the apparatus used in the working example.

FIG. 2 is an image of the apparatus used in the experiment. In FIG. 2, apparatus 100 includes solution-permeable container 200, which itself includes solution-permeable outer layer 210 of electrically insulating material substantially surrounding other components of the container. Apparatus 100 further includes an acid bath 300 adapted for least partially immersing the solution-permeable container in an acidic aqueous solution 310; an agitator 400 (in this embodiment, the agitator is a rotator) for rotating the solution-permeable container in the acid bath; and a power supply 500 for applying a voltage between the anode and the cathode.

Figure 3:
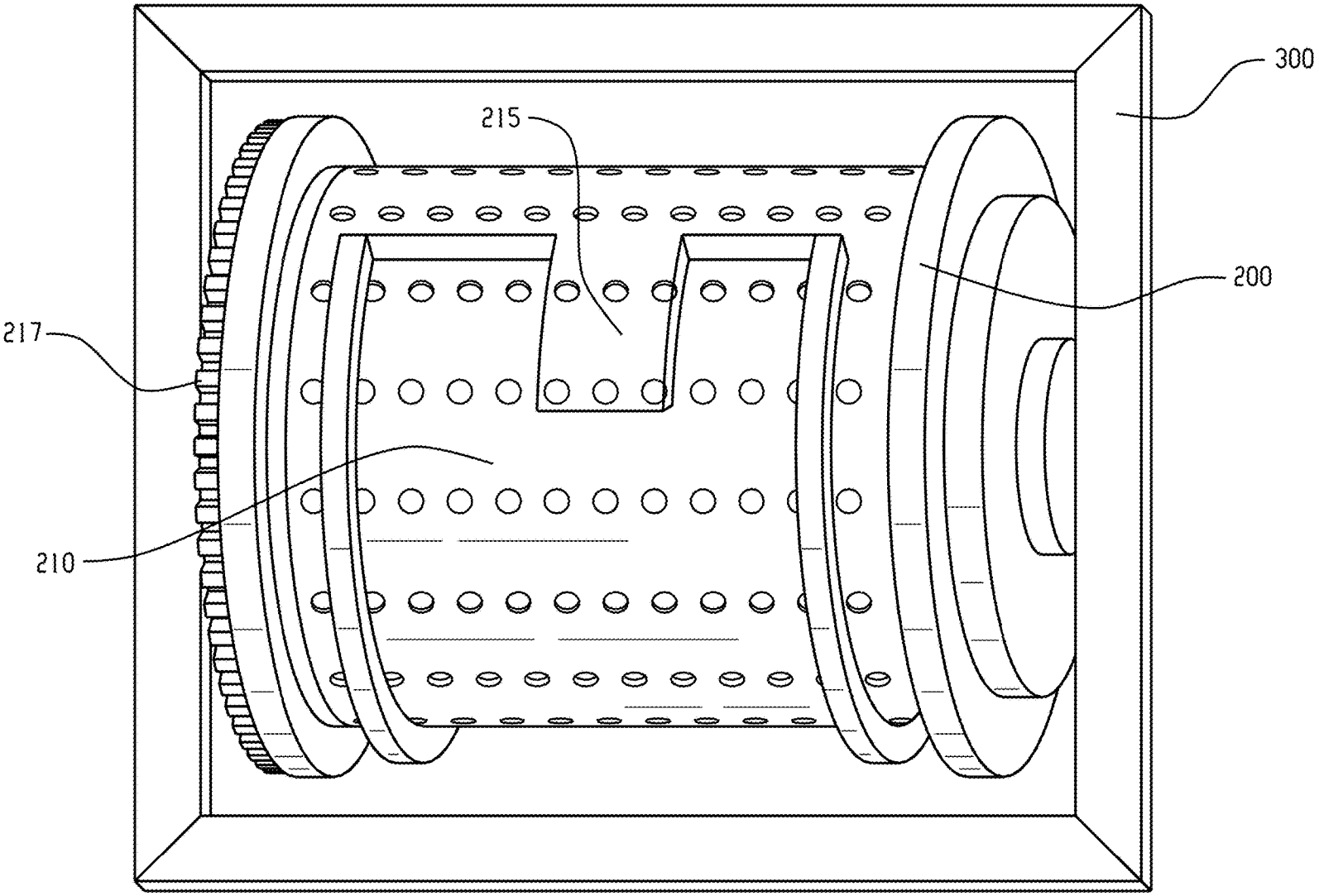
FIG. 3 is an image (top view) of solution-permeable container 200 in acid bath 300.

FIG. 3 is an image (top view) of solution-permeable container 200 in acid bath 300. Visible in solution-permeable outer layer 210 is door 215, which is opened to load ammunition and remove recovered coarse solids (e.g., recovered lead bullets), and closed during operation. Also visible is geared edge 217 that engages the agitator 400 (not shown).

Figure 4:
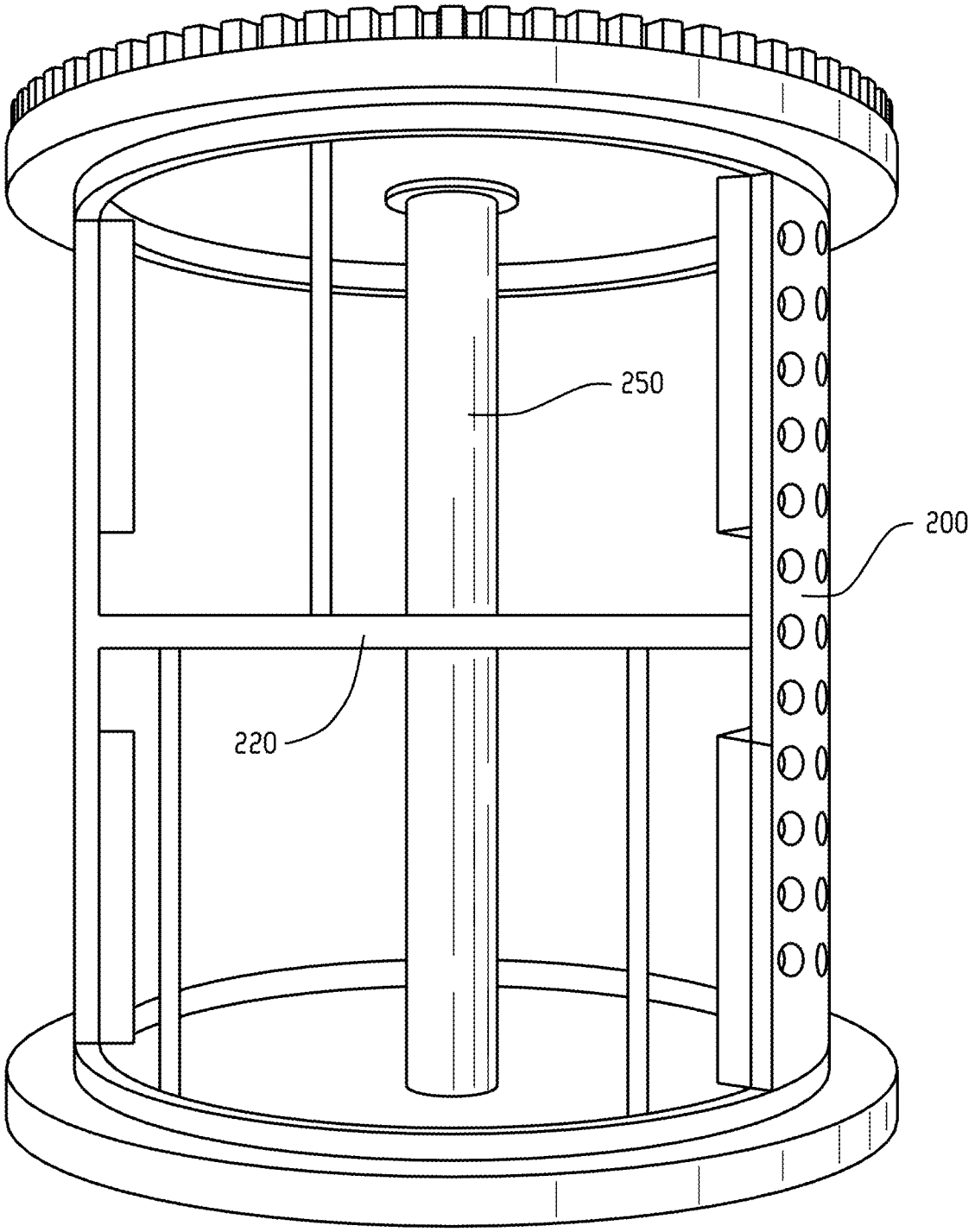
FIG. 4 is an image of solution permeable container 200, showing cathode 250 and anode 220.

FIG. 4 is an image of solution permeable container 200 from which most of the solution-permeable outer layer 210 has been removed. Visible are cathode 250 comprising copper, and some of the lead-containing structural members that make up anode 220.

Figure 5:
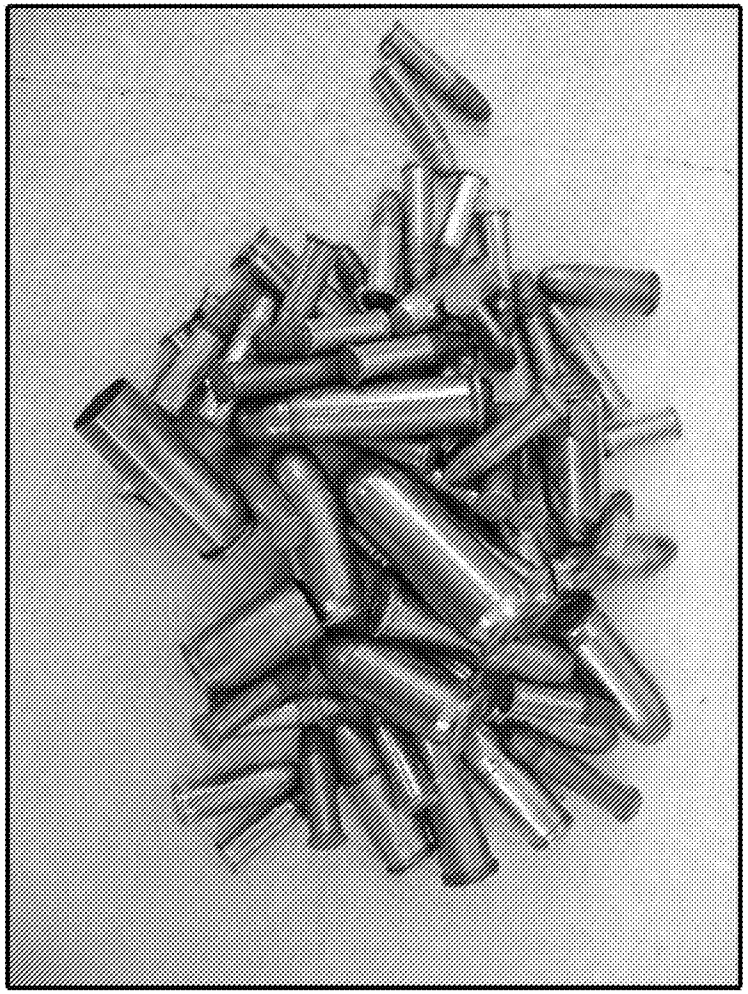
FIG. 5 is an image of assorted ammunition cartridges, including some shell casings, used a process feed.
Figure 6:
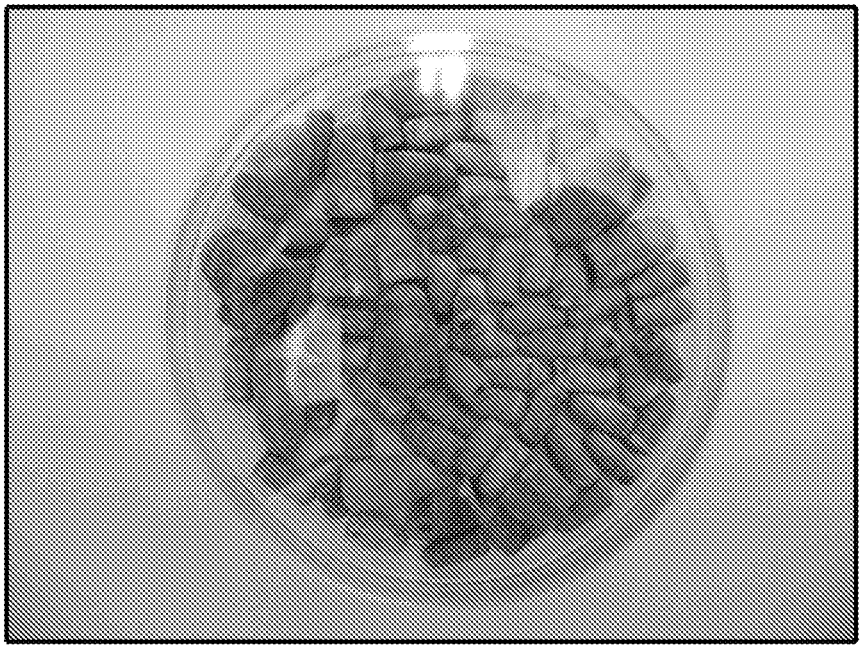
FIG. 6 is an image of metallic lead recovered from the process.
Figure 7:
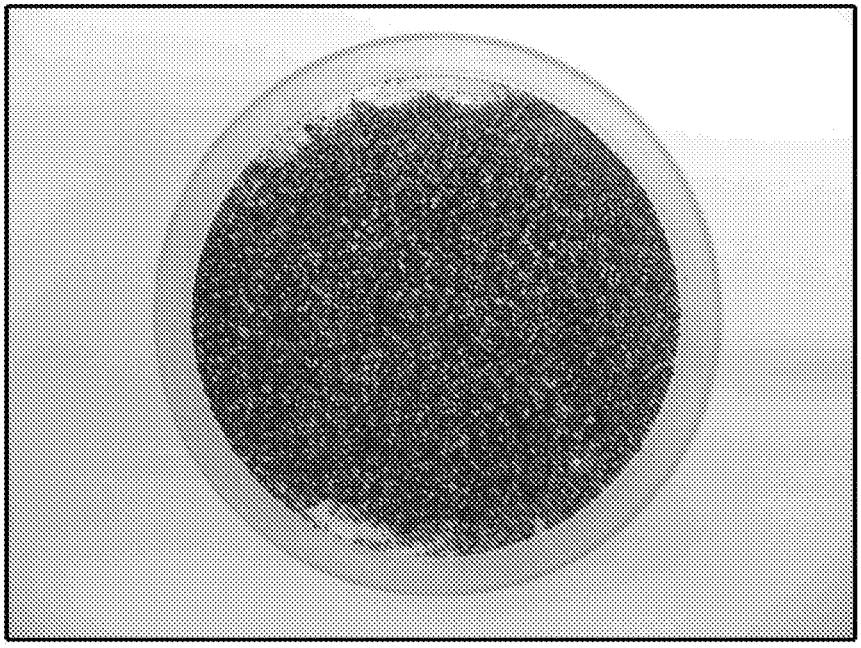
FIG. 7 is an image of metallic copper recovered from the process.
Figure 8:
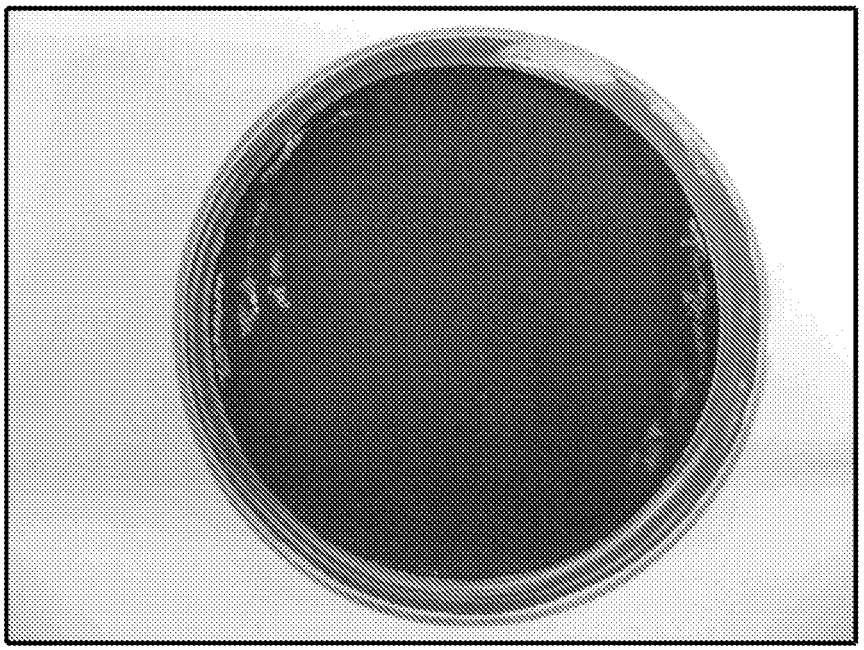
FIG. 8 is an image of gunpowder recovered from the process.
Figure 9:
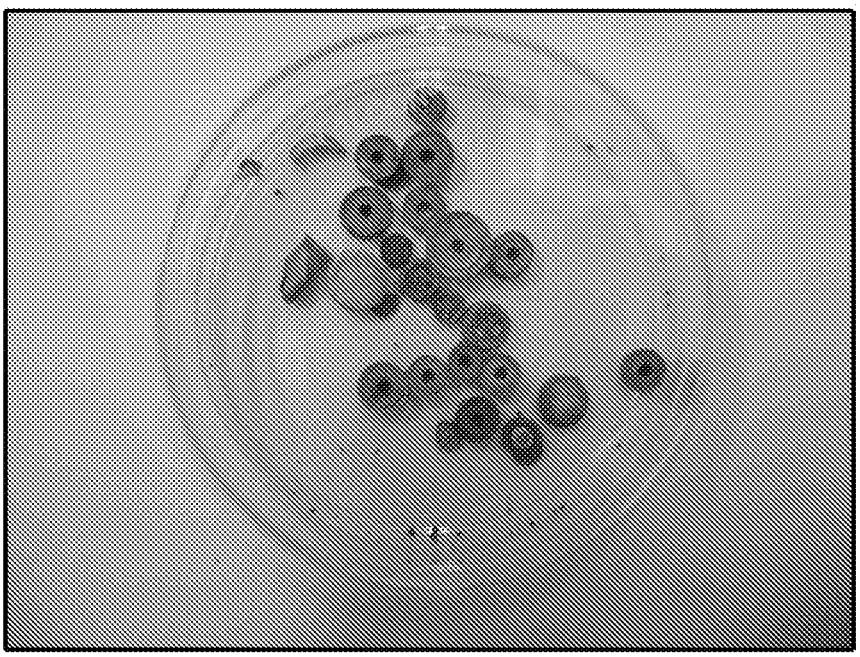
FIG. 9 is an image of primers recovered from the process.
Figure 10:
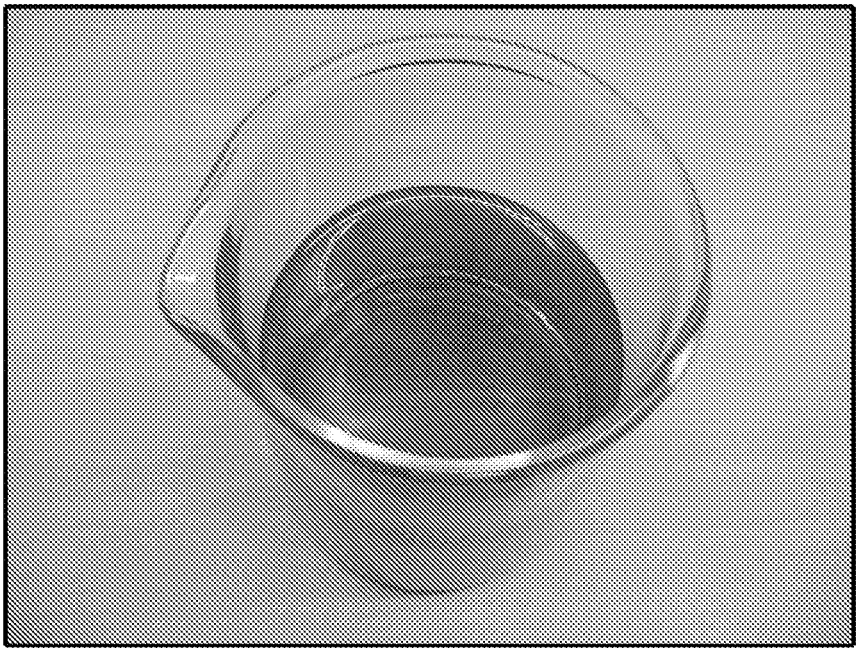
FIG. 10 is an image of acidic aqueous solution recovered from the process, the solution containing zinc ions and copper ions.

The procedure for ammunition disposal and material recovery was as follows. The door of the solution-permeable container was opened and 1 pound (0.45 kilogram) of assorted cartridges was added to the container. FIG. 5 is an image of assorted cartridges, including some shell casings. The cartridges varied in caliber from about 0.22 to about 0.45 and above. The solution-permeable container was then placed in the (unfilled) acid bath so that the gears of the container engaged the motorized gears inside the acid bath. A 9 weight percent sulfuric acid solution (5.5 liters) was prepared by diluting concentrated sulfuric acid with water. The sulfuric acid solution was added to acid bath, thereby partially immersing the solution-permeable container. The motor powering motorized gears inside the acid bath was turned on, thereby initiating rotation of the container in the acid bath. The power supply was turned on, and the voltage was adjusted to 1.5 volts to provide a current of 2.9 amperes. These conditions were maintained for 48 hours, resulting in a power consumption of 0.21 kilowatt-hours, lead recovery of 280.4 grams (98.2%; see FIG. 6 for an image of recovered lead), copper recovery of 102.4 grams in powder form (84.1%; see FIG. 7), gunpowder recovery of 6.3 grams in powder form (44.7%; see FIG. 8 for an image of recovered gunpowder), primer recovery (16.5 grams; see FIG. 9 for an image of recovered primers), and zinc recovery (as zinc sulfate dissolved in the sulfuric acid solution; see FIG. 10). The lead-based bullet cores were retained in the solution-permeable container, while powdered copper, gunpowder, and primers were collected from the floor of the acid bath. Copper was separated by converting the powder to a high concentration copper sulfate solution suitable for electrowinning. Primers and gunpowder were separated by screening.

The invention claimed is:

1. A method for electrochemical ammunition disposal and material recovery, the method comprising:

placing a plurality of ammunition cartridges in an acidic aqueous solution that is in contact with a cathode and an anode; wherein at least a portion of the ammunition cartridges comprises a casing comprising an alloy comprising copper and zinc;

agitating the plurality of ammunition cartridges within the acidic aqueous solution;

applying a voltage between the anode and the cathode, the voltage being effective to oxidize and dissolve zinc from the alloy comprising copper and zinc; and recovering alloy-derived metallic copper as a solid, and alloy-derived zinc ion as a solution, wherein at least a portion of the alloy-derived metallic copper is recovered as a powdered solid, wherein the agitating and the applying are performed in any order or at the same time, and wherein the acidic aqueous solution comprises sulfuric acid.

2. The method of claim 1, wherein said placing the plurality of ammunition cartridges in the acidic aqueous solution comprises enclosing the ammunition cartridges in a solution-permeable container comprising the anode and the cathode, and at least partially immersing the solution-permeable container in the acidic aqueous solution; wherein the solution-permeable container further comprises a solution-permeable outer layer of electrically insulating material substantially enclosing the ammunition cartridges; wherein the anode comprises lead; and wherein the cathode comprises copper.

3. The method of claim 2, wherein the electrically insulating material comprises a thermoplastic having a volume resistivity of at least $10^{12}$ ohm-centimeters.

4. The method of claim 2, wherein said agitating the plurality of ammunition cartridges within the acidic aqueous solution comprises rotating the solution-permeable container.

5. The method of claim 1, wherein at least a portion of the ammunition cartridges has a caliber of 0.1 to 2.

6. The method of claim 1, wherein at least a portion of the ammunition cartridges further comprises a bullet, a primer, and gunpowder.

7. The method of claim 1, wherein the anode comprises at least 80 weight percent lead.

8. The method of claim 1, wherein the cathode comprises at least 50 weight percent copper.

9. The method of claim 1, wherein the acidic aqueous solution comprises sulfuric acid at a concentration of 5 to 20 weight percent, based on the weight of the acidic aqueous solution.

10. The method of claim 1, wherein the voltage between the anode and the cathode is 0.5 to 20 volts.

11. The method of claim 1, wherein at least a portion of the alloy-derived zinc ion is recovered as a zinc sulfate solution.

12. The method of claim 1, wherein the plurality of ammunition cartridges are agitated within the acidic aqueous solution before applying the voltage, and the plurality of ammunition cartridges are agitated while the voltage is applied between the anode and the cathode.

13. The method of claim 1, wherein the plurality of ammunition cartridges are agitated within the acidic aqueous solution while applying the voltage between the anode and the cathode.

14. A method for electrochemical ammunition disposal and material recovery, the method comprising:

placing a plurality of ammunition cartridges in an acidic aqueous solution that is in contact with a cathode and an anode; wherein at least a portion of the ammunition cartridges comprises a casing comprising an alloy comprising copper and zinc; and wherein at least a portion of the ammunition cartridges further comprises a bullet comprising lead, a primer, and gunpowder;

agitating the plurality of ammunition cartridges within the acidic aqueous solution;

applying a voltage between the anode and the cathode, the voltage being effective to oxidize and dissolve zinc from the alloy comprising copper and zinc; and recovering alloy-derived metallic copper as a solid, and alloy-derived zinc ion as a solution, wherein the agitating and the applying are performed in any order or at the same time, and wherein at least a portion of bullet-derived lead, at least a portion of the primer, and at least a portion of the gunpowder are each recovered as solids.

15. The method of claim 14, wherein the acidic aqueous solution comprises sulfuric acid.

16. The method of claim 14, wherein said placing the plurality of ammunition cartridges in the acidic aqueous solution comprises enclosing the ammunition cartridges in a solution-permeable container comprising the anode and the cathode, and at least partially immersing the solution-permeable container in the acidic aqueous solution; wherein the solution-permeable container further comprises a solution-permeable outer layer of electrically insulating material substantially enclosing the ammunition cartridges.

17. The method of claim 16, wherein said agitating the plurality of ammunition cartridges within the acidic aqueous solution comprises rotating the solution-permeable container.

18. The method of claim 14, wherein the plurality of ammunition cartridges are agitated within the acidic aqueous solution before applying the voltage, and the plurality of ammunition cartridges are agitated while the voltage is applied between the anode and the cathode.

19. A method for electrochemical ammunition disposal and material recovery, the method comprising:

placing a plurality of ammunition cartridges in an acidic aqueous solution that is in contact with a cathode and an anode; wherein at least a portion of the ammunition cartridges comprises a casing comprising an alloy comprising copper and zinc; wherein at least a portion of the ammunition cartridges further comprises a bullet comprising lead, a primer, and gunpowder; and wherein the ammunition cartridges each independently has a caliber of 0.1 to 2;

agitating the plurality of ammunition cartridges within the acidic aqueous solution;

applying a voltage between the anode and the cathode, the voltage being effective to oxidize and dissolve zinc from the alloy comprising copper and zinc; and recovering alloy-derived metallic copper as a solid, and alloy-derived zinc ion as a solution, wherein the agitating and the applying are performed in any order or at the same time, wherein the anode comprises at least 80 weight percent lead;

wherein the cathode comprises at least 80 weight percent copper; and wherein at least a portion of bullet-derived lead, at least a portion of the primer, and at least a portion of the gunpowder are each recovered as solids.

20. The method of claim 19, wherein the plurality of ammunition cartridges are agitated within the acidic aqueous solution before applying the voltage, and the plurality of ammunition cartridges are agitated while the voltage is applied between the anode and the cathode.

* * * * *